US009528068B2

(12) United States Patent
Davies et al.

(10) Patent No.: US 9,528,068 B2
(45) Date of Patent: Dec. 27, 2016

(54) LUBRICANTS WITH GOOD TBN RETENTION

(75) Inventors: Mark C. Davies, Belper (GB); Stephen J. Cook, Belper (GB); Alexandra Mayhew, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 13/984,288

(22) PCT Filed: Feb. 15, 2012

(86) PCT No.: PCT/US2012/025203

§ 371 (c)(1),
(2), (4) Date: Oct. 9, 2013

(87) PCT Pub. No.: WO2012/112658

PCT Pub. Date: Aug. 23, 2012

(65) Prior Publication Data

US 2015/0045268 A1 Feb. 12, 2015

Related U.S. Application Data

(60) Provisional application No. 61/443,792, filed on Feb. 17, 2011.

(51) Int. Cl.

| | |
|---|---|
| ***C10M 169/04*** | (2006.01) |
| ***C10M 139/00*** | (2006.01) |
| ***C10M 159/24*** | (2006.01) |
| ***C10M 141/08*** | (2006.01) |
| ***C10M 163/00*** | (2006.01) |

(52) U.S. Cl.

CPC ..... *C10M 141/08* (2013.01); *C10M 163/00* (2013.01); *C10M 2207/028* (2013.01); *C10M 2207/123* (2013.01); *C10M 2215/086* (2013.01); *C10M 2215/28* (2013.01); *C10M 2219/046* (2013.01); *C10M 2223/045* (2013.01); *C10N 2210/02* (2013.01); *C10N 2230/52* (2013.01); *C10N 2240/10* (2013.01)

(58) Field of Classification Search

CPC ..... C10M 2215/28; C10M 2207/129; C10M 2219/046; C10M 2219/089; C10N 2210/02

USPC ..... 508/306, 192, 391, 460, 574

See application file for complete search history.

(56) References Cited

U.S. PATENT DOCUMENTS

| | | | | |
|---|---|---|---|---|
| 2006/0014653 | A1 | 1/2006 | Busse et al. | |
| 2009/0305924 | A1 | 12/2009 | Mayhew et al. | |
| 2011/0015105 | A1* | 1/2011 | Davies et al. | 508/280 |
| 2012/0028522 | A1* | 2/2012 | Garner et al. | 440/88 L |

FOREIGN PATENT DOCUMENTS

| | | |
|---|---|---|
| EP | 0355895 A2 | 2/1990 |
| EP | 1676902 | 7/2007 |
| WO | 2005/061682 | 7/2005 |
| WO | 2010/009036 | 1/2010 |

OTHER PUBLICATIONS

Written Opinion of corresponding International Application No. PCT/US2012/025703 dated Apr. 11, 2012.
Corresponding PCT Publication No. WO 2012/112658 A1 and Search Report published Aug. 23, 2012.

* cited by examiner

*Primary Examiner* — Vishal Vasisth
(74) *Attorney, Agent, or Firm* — David M. Shold, Esq.; Teresan W. Gilbert, Esq.

(57) ABSTRACT

A lubricant composition containing a metal-containing detergent in an amount to provide at least about 2 TBN to the lubricant, and a dispersant comprising an oleophilic portion comprising at least about 40 carbon atoms and an acid-bearing portion, characterized in having a TAN:TBN ratio of at least about 0.8, exhibits good TBN retention.

12 Claims, No Drawings

LUBRICANTS WITH GOOD TBN RETENTION

This application is a 371 of PCT/US12/25203, filed Feb. 15, 2012, which claims benefit of 61/443,792, filed Feb. 17, 2011.

BACKGROUND OF THE INVENTION

The disclosed technology relates to a lubricant, suitable for use in an internal combustion engine, which containing a metal-containing detergent which provides basicity to the lubricant. A defined dispersant is present, leading to superior retention of the basicity (TBN, ASTM D 974) during use of the lubricant.

Lubrication of internal combustion engines has been a practice for many decades, yet continual improvement in lubricant technology is ongoing as new engines and new standards have been developed. Formulations directed to passenger car engines, for instance, must address limits placed on sulfated ash, phosphorus, and sulfur content ("SAPS"), and restrictions in these components often lead to upper limits on the amount of metal-containing detergent that can be included in the lubricant. One of the benefits that metal-containing detergents provide to the lubricant is basicity (measurable as TBN), which is available for various functions, including neutralization of acidic byproducts of combustion. At the same time, some engine tests specify a minimum TBN level remaining at the end of the test. Therefore, "TBN retention" has become an important parameter in design and selection of engine lubricants. Good TBN retention is associated with the ability of a lubricant to protect the engine from corrosive wear and maintaining that protection over an extended period of time.

The disclosed technology, therefore, solves the problem of providing good TBN retention (and associated benefits) by selection of a suitable dispersant, as described herein. The desirable dispersants typically have a high total acid number (TAN).

SUMMARY OF THE INVENTION

The disclosed technology provides a lubricant composition comprising: (a) an oil of lubricating viscosity; (b) at least one metal-containing detergent in an amount to provide at least 2 TBN to the lubricant; (c) a dispersant comprising an oleophilic portion comprising at least 40 carbon atoms and an acid-bearing portion, characterized in having a TAN:TBN ratio of at least 0.8, wherein said dispersant is present in an amount of at least 0.1 percent by weight and wherein said dispersant provides at least 0.025 TAN to the lubricant composition. In one embodiment the lubricant has a sulfated ash value of up to 1.1 percent.

The disclosed technology also provides a method for lubricating a mechanical device, comprising supplying thereto the above-described lubricating composition. The mechanical device may be an internal combustion engine.

The disclosed technology further provides a method for improving the retention of TBN in a lubricant employed for lubricating an internal combustion engine, wherein the lubricant may have a sulfated ash value of up to 1.1 percent and comprises (a) an oil of lubricating viscosity and (b) at least one metal-containing detergent in an amount to provide at least 2 TBN to the lubricant; said method comprising including within said lubricant (c) a dispersant comprising an oleophilic portion comprising at least 40 carbon atoms and an acid-bearing portion, characterized in having a TAN:TBN ratio of at least 0.8, wherein said dispersant is present in an amount of at least 0.1 percent by weight and wherein said dispersant provides at least 0.025 TAN to the lubricant composition.

The disclosed technology further provides for the use of a dispersant comprising an oleophilic portion comprising at least about 40 carbon atoms and an acid-bearing portion, characterized in having a TAN:TBN ratio of at least about 0.8, to improve the TBN retention of a lubricant employed for lubricating an internal combustion engine, wherein said lubricant comprises (a) an oil of lubricating viscosity and (b) at least one metal-containing detergent in an amount to provide at least about 2 TBN to the lubricant; wherein said dispersant is present in an amount of at least about 0.1 percent by weight and wherein said dispersant provides at least about 0.025 TAN to the lubricant composition.

DETAILED DESCRIPTION OF THE INVENTION

Various features and embodiments will be described below by way of non-limiting illustration.

One component of the disclosed technology is an oil of lubricating viscosity, also referred to as a base oil. The base oil may be selected from any of the base oils in Groups I-V of the American Petroleum Institute (API) Base Oil Interchangeability Guidelines, namely

| Base Oil Category | Sulfur (%) | Saturates(%) | Viscosity Index |
|---|---|---|---|
| Group I | >0.03 and/or | <90 | 80 to 120 |
| Group II | ≤0.03 and | ≥90 | 80 to 120 |
| Group III | ≤0.03 and | ≥90 | >120 |
| Group IV | All polyalphaolefins (PAOs) | | |
| Group V | All others not included in Groups I, II, III or IV | | |

Groups I, II and III are mineral oil base stocks. The oil of lubricating viscosity can include natural or synthetic oils and mixtures thereof. Mixture of mineral oil and synthetic oils, e.g., polyalphaolefin oils and/or polyester oils, may be used.

Natural oils include animal oils and vegetable oils (e.g. vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are also useful oils of lubricating viscosity. Oils of lubricating viscosity derived from coal or shale are also useful.

Synthetic oils include hydrocarbon oils and halosubstituted hydrocarbon oils such as polymerized and interpolymerized olefins and mixtures thereof, alkylbenzenes, polyphenyl, alkylated diphenyl ethers, and alkylated diphenyl sulfides and their derivatives, analogs and homologues thereof. Alkylene oxide polymers and interpolymers and derivatives thereof, and those where terminal hydroxyl groups have been modified by, e.g., esterification or etherification, are other classes of synthetic lubricating oils. Other suitable synthetic lubricating oils comprise esters of dicarboxylic acids and those made from $C_5$ to $C_{12}$ monocarboxylic acids and polyols or polyol ethers. Other synthetic lubricating oils include liquid esters of phosphorus-containing acids, polymeric tetrahydrofurans, silicon-based oils such as poly-alkyl-, polyaryl-, polyalkoxy-, or polyaryloxy-siloxane oils, and silicate oils.

Other synthetic oils include those produced by Fischer-Tropsch reactions, typically hydroisomerized Fischer-Tropsch hydrocarbons or waxes. In one embodiment oils may be prepared by a Fischer-Tropsch gas-to-liquid synthetic procedure as well as other gas-to-liquid oils.

Unrefined, refined, and rerefined oils, either natural or synthetic (as well as mixtures thereof) of the types disclosed hereinabove can used. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Rerefined oils often are additionally processed to remove spent additives and oil breakdown products.

The lubricants of the disclosed technology will also include at least one metal-containing detergent in an amount to provide at least 2 TBN to the lubricant. Metal-containing detergents are typically overbased materials, or overbased detergents, and in one embodiment, the metal-containing detergent comprises an overbased detergent. Overbased materials, otherwise referred to as overbased or superbased salts, are generally homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, such as carbon dioxide) with a mixture comprising an acidic organic compound, a reaction medium comprising at least one inert, organic solvent (e.g., mineral oil, naphtha, toluene, xylene) for said acidic organic material, a stoichiometric excess of a metal base, and a promoter such as a phenol or alcohol and optionally ammonia. The acidic organic material will normally have a sufficient number of carbon atoms, for instance, as a hydrocarbyl substituent, to provide a reasonable degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. It is recognized that some overbased detergents are conventionally prepared using a hydrocarbyl-substituted succinic anhydride, in a small amount, as a processing or manufacturing aid. Accordingly, a small amount of the corresponding metal salt may be present in the overbased detergent as it is commercially supplied. This minor, incidental presence is not to be considered the presence of the dispersant as described herein.

Overbased detergents are often characterized by Total Base Number (TBN). TBN is the amount of strong acid needed to neutralize all of the overbased material's basicity, expressed as potassium hydroxide (mg KOH per gram of sample). Since overbased detergents are commonly provided in a form which contains a certain amount of diluent oil, for example, 40-50% oil, the actual TBN value for such a detergent will depend on the amount of such diluent oil present, irrespective of the "inherent" basicity of the overbased material. For the purposes of the present invention, the TBN of an overbased detergent is to be recalculated to an oil-free basis. Detergents which are useful in the present technology may typically have a TBN (oil-free basis) of 100 to 800, and in one embodiment 150 to 750, and in another, 400 to 700. If multiple detergents are employed, the overall TBN of the detergent component (that is, an average of all the specific detergents together) will typically be in the above ranges, and the required contribution to the TBN of the metal-containing detergent component will be the total of the contributions of each individual detergent.

The overall TBN of the composition, including oil, will be derived from the TBN contribution of the individual components, such as the dispersant, the detergent, and other basic materials. The overall TBN will, in some embodiments, be at least 7 or at least 10, or sometimes even at least 20. The amount of TBN provided by the metal-containing detergent will be at least 2 or at least 4 or at least 6, and the amount of the metal containing detergent or detergents will typically be an amount suitable to provide such TBN levels. In certain embodiments, the actual amount of the metal-containing detergent (or detergents) may be 0.2 to 5 percent by weight or 0.3 to 3 percent or 0.5 to 2 percent or 0.9 to 1.5 percent by weight. The skilled person will recognize that, if a metal-containing detergent is used at 0.2 percent by weight and it is to contribute at least 2 TBN to the formulation, then that detergent itself must have a TBN of at least 1000 (amounts and TBN values expressed on oil-free basis).

Sulfated ash (ASTM D-874) is another parameter often used to characterize such compositions. Certain of the compositions of the present invention can have sulfated ash levels of up to 2.0% (that is, with a lower limit of 0% or 0.05%) or up to 1.8 or to 1.6 or to 1.4%, such as 0.1 to 1.1% or 0.2 to 1.0% or 0.3 to 0.8% or 0.3 to 0.8% or 0.5 to 0.8%.

The metal compounds useful in making the basic metal salts are generally any Group 1 or Group 2 metal compounds (CAS version of the Periodic Table of the Elements). The Group 1 metals of the metal compound include Group 1a alkali metals such as sodium, potassium, and lithium, as well as Group 1b metals such as copper. The Group 1 metals can be sodium, potassium, lithium and copper, and in one embodiment sodium or potassium, and in another embodiment, sodium. The Group 2 metals of the metal base include the Group 2a alkaline earth metals such as magnesium, calcium, and barium, as well as the Group 2b metals such as zinc. In one embodiment the Group 2 metals are magnesium, calcium, barium, or zinc, and in another embodiments magnesium or calcium. In certain embodiments the metal is calcium or sodium or a mixture of calcium and sodium. Generally the metal compounds are delivered as metal salts. The anionic portion of the salt can be hydroxide, oxide, carbonate, borate, or nitrate.

Such overbased materials are well known to those skilled in the art. Patents describing techniques for making basic salts of sulfonic acids, carboxylic acids, (hydrocarbyl-substituted) phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

In one embodiment the lubricants of the present invention can contain an overbased sulfonate detergent. Suitable sulfonic acids include sulfonic and thiosulfonic acids. Sulfonic acids include the mono- or polynuclear aromatic or cycloaliphatic compounds. Oil-soluble sulfonates can be represented for the most part by one of the following formulas: $R^2$-T-$(SO_3—)_a$ and $R^3$—$(SO_3—)_b$, where T is a cyclic nucleus such as typically benzene or toluene; $R^2$ is an aliphatic group such as alkyl, alkenyl, alkoxy, or alkoxyalkyl; $(R^2)$-T typically contains a total of at least 15 carbon atoms; and $R^3$ is an aliphatic hydrocarbyl group typically containing at least 15 carbon atoms. Examples of $R^3$ are alkyl, alkenyl, alkoxyalkyl, and carboalkoxyalkyl groups. The groups T, $R^2$, and $R^3$ in the above formulas can also contain other inorganic or organic substituents. In the above formulas, a and b are at least 1. In one embodiment the sulfonate detergent may be a predominantly linear alkylbenzenesulfonate detergent having a metal ratio of at least 8 as described in paragraphs [0026] to [0037] of US Patent Application 2005/065045. In some embodiments the linear alkyl group may be attached to the benzene ring anywhere along the linear chain of the alkyl group, but often in the 2, 3 or 4 position of the linear chain, and in some instances predominantly in the 2 position.

Another overbased material which can be present is an overbased phenate detergent. The phenols useful in making phenate detergents can be represented by the formula $(R^1)_a$—Ar—$(OH)_b$, wherein $R^1$ is an aliphatic hydrocarbyl group of 4 to 400 carbon atoms, or 6 to 80 or 6 to 30 or 8 to 25 or 8 to 15 carbon atoms; Ar is an aromatic group (which can be a benzene group or another aromatic group such as toluene or naphthalene); a and b are independently numbers of at least one, the sum of a and b being in the range of two up to the number of displaceable hydrogens on the aromatic nucleus or nuclei of Ar. In one embodiment, a and b are independently numbers in the range of 1 to 4, or 1 to 2. $R^1$ and a are typically such that there is an average of at least 8 aliphatic carbon atoms provided by the $R^1$ groups for each phenol compound. Phenate detergents are also sometimes provided as sulfur-bridged species. In one embodiment, the metal-containing detergent comprises a calcium phenate detergent. In one embodiment, the calcium phenate detergent is not overbased, that is, it may contain a substantially stoichiometric amount of metal. Such non-overbased phenate detergents are still typically basic in character (perhaps because of the relatively weakly acidic character of the phenol substrate) and thus will still typically contribute TBN to a lubricant.

In one embodiment, the metal-containing detergent comprises an overbased calcium sulfonate, an overbased calcium phenate, or mixtures thereof.

In one embodiment, the overbased material is an overbased saligenin detergent. Overbased saligenin detergents are commonly overbased magnesium salts which are based on saligenin derivatives. A general example of such a saligenin derivative can be represented by the formula

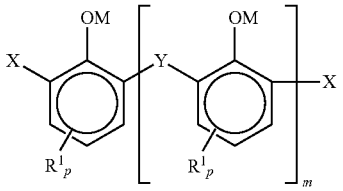

wherein X comprises —CHO or —$CH_2OH$, Y comprises —$CH_2$— or —$CH_2OCH_2$—, and wherein such —CHO groups typically comprise at least 10 mole percent of the X and Y groups; M is hydrogen, ammonium, or a valence of a metal ion (that is to say, in the case of a multivalent metal ion, one of the valences is satisfied by the illustrated structure and other valences are satisfied by other species such as anions, or by another instance of the same structure), $R_1$ is a hydrocarbyl group containing 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. In one embodiment, M is a valence of a Mg ion or a mixture of Mg and hydrogen. Other metals include alkali metals such as lithium, sodium, or potassium; alkaline earth metals such as calcium or barium; and other metals such as copper, zinc, and tin. As used in this document, the expression "represented by the formula" indicates that the formula presented is generally representative of the structure of the chemical in question. However, it is well known that minor variations can occur, including in particular positional isomerization, that is, location of the X, Y, and R groups at different position on the aromatic ring from those shown in the structure. The expression "represented by the formula" is expressly intended to encompass such variations. Saligenin detergents are disclosed in greater detail in U.S. Pat. No. 6,310,009, with special reference to their methods of synthesis (Column 8 and Example 1) and preferred amounts of the various species of X and Y (Column 6).

Salixarate detergents are overbased materials that can be represented by a substantially linear (as opposed to macrocylcic) compound comprising at least one unit of formula (I) or formula (II):

(I)

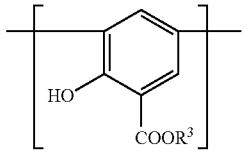

(II)

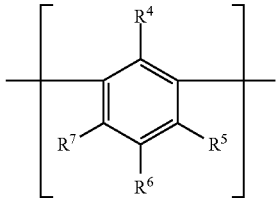

each end of the compound having a terminal group of formula (III) or (IV):

(III)

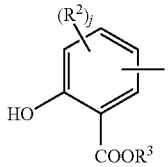

(IV)

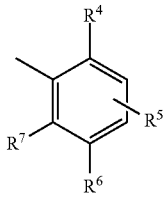

such groups being linked by divalent bridging groups A, which may be the same or different for each linkage; wherein in formulas (I)-(IV) $R^3$ is hydrogen or a hydrocarbyl group or a valence of a metal ion; $R^2$ is hydroxyl or a hydrocarbyl group and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is about 0.1:1 to about 2:1. The divalent bridging group "A," which may be the same or different in each occurrence, includes —$CH_2$— (methylene bridge) and —$CH_2OCH_2$— (ether bridge), either of which may be derived from formaldehyde or a formaldehyde equivalent (e.g., paraform, formalin).

Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Glyoxylate detergents are similar overbased materials which are based on an anionic group which, in one embodiment, may have the structure

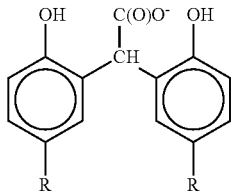

wherein each R is independently an alkyl group containing at least 4, and in certain embodiments at least 8 carbon atoms, provided that the total number of carbon atoms in all such R groups is at least 12, or at least 16 or 24. Alternatively, each R can be an olefin polymer substituent. The acidic material upon from which the overbased glyoxylate detergent is prepared is the condensation product of a hydroxyaromatic material such as a hydrocarbyl-substituted phenol with a carboxylic reactant such as glyoxylic acid and other omega-oxoalkanoic acids. Overbased glyoxylic detergents and their methods of preparation are disclosed in greater detail in U.S. Pat. No. 6,310,011 and references cited therein.

The overbased detergent can also be an overbased salicylate which may be an alkali metal salt or an alkaline earth metal salt of an alkylsalicylic acid. The salicylic acids may be hydrocarbyl-substituted salicylic acids wherein each substituent contains an average of at least 8 carbon atoms per substituent and 1 to 3 substituents per molecule. The substituents can be polyalkene substituents, where polyalkenes include homopolymers and interpolymers of polymerizable olefin monomers of 2 to 16, or 2 to 6, or 2 to 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the hydrocarbyl substituent group or groups on the salicylic acid contains 7 to 300 carbon atoms and can be an alkyl group having a molecular weight of 150 to 2000. The polyalkenes and polyalkyl groups are prepared by conventional procedures, and substitution of such groups onto salicylic acid can be effected by known methods. Alkyl salicylates may be prepared from an alkylphenol by Kolbe-Schmitt reaction; alternatively, calcium salicylate can be produced by direct neutralization of alkylphenol and subsequent carbonation. Overbased salicylate detergents and their methods of preparation are disclosed in U.S. Pat. Nos. 4,719,023 and 3,372,116.

Other overbased detergents can include overbased detergents having a Mannich base structure, as disclosed in U.S. Pat. No. 6,569,818.

In certain embodiments, the hydrocarbyl substituents on hydroxy-substituted aromatic rings in the above detergents (e.g., phenate, saligenin, salixarate, glyoxylate, or salicylate) are free of or substantially free of $C_{12}$ aliphatic hydrocarbyl groups (e.g., less than 1%, 0.1%, or 0.01% by weight of the substituents are $C_{12}$ aliphatic hydrocarbyl groups). In some embodiments such hydrocarbyl substituents contain at least 14 or at least 18 carbon atoms.

Another component of the disclosed technology is a dispersant. Dispersants, generally, are well known in the field of lubricants and include primarily what is known as ashless dispersants and polymeric dispersants. Ashless dispersants are so-called because, as supplied, they do not contain metal and thus do not normally contribute to sulfated ash when added to a lubricant. However they may, of course, interact with ambient metals once they are added to a lubricant which includes metal-containing species. Ashless dispersants are characterized by a polar group attached to a relatively high molecular weight hydrocarbon chain. Typical ashless dispersants include N-substituted long chain alkenyl succinimides, having a variety of chemical structures including typically

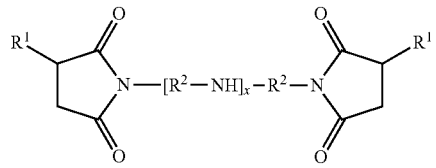

where each $R^1$ is independently an alkyl group, frequently a polyisobutylene group with a molecular weight ($M_n$) of 500-5000 based on the polyisobutylene precursor, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. In the above structure, the amine portion is shown as an alkylene polyamine, although other aliphatic and aromatic mono- and polyamines may also be used. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895. In certain embodiments, the dispersant is prepared by a process that involves the presence of small amounts of chlorine or other halogen, as described in U.S. Pat. No. 7,615,521, see, e.g., col. 4 and preparative example A. Such dispersants typically have some carbocyclic structures in the attachment of the hydrocarbyl substituent to the acidic or amidic "head" group. In other embodiments, the dispersant is prepared by a thermal process involving an "ene" reaction, without the use of any chlorine or other halogen, as described in U.S. Pat. No. 7,615,521. See col. 4, bottom, col.

5, and preparative example B. Such dispersants typically do not contain the above-described carbocyclic structures at the point of attachment.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

A succinic-based dispersant (succinimide, succinamide, succinic ester, and mixtures thereof) may be formed by reacting maleic anhydride or a reactive equivalent thereof, such as an acid or ester, with a hydrocarbon chain by any method such as those disclosed above (e.g., chlorine-based process or thermal process). Other acids or equivalents thereof may be used in place of the maleic anhydride; these include fumaric acid, itaconic acid, itaconic anhydride, citraconic acid, citaconic anhydride, and cinnamic acid as well as other ethylenically unsaturated acids such as acrylic or methacrylic acid; and their reactive equivalents.

Another class of ashless dispersant is Mannich bases. These are materials which are formed by the condensation of a higher molecular weight, alkyl substituted phenol, an alkylene polyamine, and an aldehyde such as formaldehyde. Such materials may have the general structure

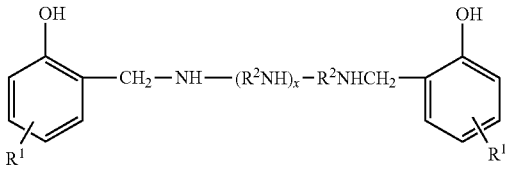

(including a variety of isomers and the like) and are described in more detail in U.S. Pat. No. 3,634,515.

Other dispersants include polymeric dispersant additives, which are generally hydrocarbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The dispersants of the disclosed technology are those which comprise an oleophilic portion comprising at least 40 carbon atoms and an acid-bearing portion. The acid-bearing portion is typically a part of or associated with the polar "head" portion of the dispersant. Although dispersants may contain reacted/condensed acidic functionality, there will be at least some acidic functionality that is not converted to a non-acidic form such as an amide, imide, or ester. (As described below, acid groups in a salt or anhydride form, e.g., the acid-amine salt, are still to be considered to provide acidic functionality.) Thus, the dispersant may, in one embodiment, comprise a polyolefin-substituted succinic acid, ester, amide, or imide, provided the dispersant contains at least some acid functionality. The acid functionality may be measured as total acid number (TAN, ASTM D 974) and will typically be an amount to impart a TAN to the dispersant of at least 3, or at least 5 or 10 or 20 or 40 (expressed on an oil-free basis). In certain embodiments the TAN of the dispersant may be up to 200 or 150 or 100.

A dispersant having acid functionality (expressed as TAN) may be provided in the acid form, or it may be provided in a salt form, neutralized, for instance, with a Group I or Group II metal (e.g., an alkali or alkaline earth metal). Such neutralization may (temporarily) reduce or eliminate the measurable TAN. For the purposes of the present technology, such metal salts are to be considered as acid-containing dispersants, and their TAN is to be regarded as that of their unneutralized form. The unneutralized form may be regenerated, if desired, by treatment of the salt with an acid. In a similar way, dispersants may contain anhydride functionality in place of the corresponding acid functionality. During the TAN measurement procedure, anhydride groups are typically hydrolyzed and titrate as TAN, so anhydride-containing dispersants are likewise to be considered as acid-containing dispersants.

The dispersant may also exhibit basicity, as measured by TBN. This will particularly be the case if the dispersant is prepared with an amine, such as a polyamine, and the amine contains one or more amino groups that have not reacted with acidic groups of the dispersant. In some embodiments, the TBN of the dispersant may be 1 to 50, or to 40 or to 20 or to 10. In some embodiments, however, the dispersant may not exhibit basicity (that is, have a TBN of 0 or nearly 0). In one embodiment the dispersant has a TBN of zero. Such could be the case if no amine nitrogen is present on the dispersant. An example of a non-basic dispersant would be a long-chain hydrocarbyl-substituted succinic acid.

The dispersants of the disclosed technology are characterized by having a TAN:TBN ratio of at least 0.8:1 (that is, at least 0.8), and in certain embodiments a TAN:TBN ratio of at least 1 or 2 or 5 or 10 or 12. In the case where the dispersant has a TBN of zero, the ratio will be considered to be at least as large as any of the above-mentioned numbers. Such dispersants may be referred to herein as a "high TAN:TBN dispersant" or "the dispersant having a TAN:TBN ratio of at least 0.8" or at least any other such number. The presence of a dispersant with any of these (generally large) TAN:TBN ratios tends to promote the retention of TBN of the metal-containing detergent, upon use in a lubricating application such as an engine lubricant.

The amount of the high TAN:TBN dispersant may be an amount of at least 0.1% of the lubricant composition, or at least 0.3% or 0.5%, and in certain embodiments at most 4% or 3% or 2% or 1.5% by weight. In certain embodiments the amount of the high TAN:TBN dispersant may be the amount to provide at least 0.025 TAN or 0.1 TAN to the lubricant composition, and in certain embodiments up to 1.0 or 0.5 TAN. Other amounts may be readily calculated from the above percentage amounts and the TAN of the particular dispersant.

In addition to the high TAN:TBN dispersant, the lubricant may also contain one or more dispersants having a TAN:TBN ratio of less than 0.8, in conventional amounts. Thus, it is not required (but it is permitted) that the entire dispersant component (e.g., mixture of different components) has a TAN:TBN ratio of at least 0.8, so long as at least one dispersant is a high TAN:TBN dispersant and is present in the required amounts. In one embodiment, the TAN:TBN ratio of all the dispersants in the lubricant, taken together, is at least 0.8.

The lubricant may further contain conventional amounts of other components that are useful for the desired end use, e.g., for an engine lubricant. Such additional components include antioxidants, friction modifiers, anti-wear agents, viscosity modifiers, and pour point depressants. These may be used individually or in combination.

Antioxidants encompass phenolic antioxidants, which may comprise a butyl substituted phenol containing 2 or 3 t-butyl groups. The para position may also be occupied by a hydrocarbyl group, an ester-containing group, or a group bridging two aromatic rings. The latter antioxidants are described in greater detail in U.S. Pat. No. 6,559,105. Antioxidants also include aromatic amines such as non-ylated diphenylamines or alkylated phenylnaphthylamine. Other antioxidants include sulfurized olefins, titanium compounds, and molybdenum compounds. U.S. Pat. No. 4,285,822, for instance, discloses lubricating oil compositions containing a molybdenum and sulfur containing composition. U.S. Patent Application Publication 2006-0217271 discloses a variety of titanium compounds, including titanium alkoxides and titanated dispersants, which materials may also impart improvements in deposit control and filterability. Other titanium compounds include titanium carboxylates such as neodecanoate. Typical amounts of antioxidants will, of course, depend on the specific antioxidant and its individual effectiveness, but illustrative total amounts can be 0.01 to 5 percent by weight or 0.15 to 4.5 percent or 0.2 to 4 percent. Additionally, more than one antioxidant may be present, and certain combinations of these can be synergistic in their combined overall effect.

Another component is a friction modifier. Friction modifiers are well known to those skilled in the art. A list of friction modifiers that may be used is included in U.S. Pat. Nos. 4,792,410, 5,395,539, 5,484,543 and 6,660,695. U.S. Pat. No. 5,110,488 discloses metal salts of fatty acids and especially zinc salts, useful as friction modifiers. A list of supplemental friction modifiers that may be used may include:

| | |
|---|---|
| fatty phosphites | borated alkoxylated fatty amines |
| fatty acid amides | metal salts of fatty acids |
| fatty epoxides | sulfurized olefins |
| borated fatty epoxides | fatty imidazolines |
| fatty amines | metal salts of alkyl salicylates |
| glycerol esters | amine salts of alkylphosphoric acids |
| borated glycerol esters | ethoxylated alcohols |
| alkoxylated fatty amines | imidazolines |
| oxazolines | polyhydroxy tertiary amines |
| hydroxyalkyl amides | molybdenum compounds |
| dialkyl tartrates | condensation products of carboxylic acids and polyalkylene-polyamines |

- - - and mixtures of two or more thereof.

Another additive is an antiwear agent. Examples of antiwear agents include phosphorus-containing antiwear/extreme pressure agents such as metal thiophosphates, phosphoric acid esters and salts thereof, phosphorus-containing carboxylic acids, esters, ethers, and amides; and phosphites. In certain embodiments a phosphorus antiwear agent may be present in an amount to deliver 0.01 to 0.2 or 0.015 to 0.15 or 0.02 to 0.1 or 0.025 to 0.08 percent phosphorus. Often the antiwear agent is a zinc dialkyldithiophosphate (ZDP). For a typical ZDP, which may contain 11 percent P (calculated on an oil free basis), suitable amounts may include 0.09 to 0.82 percent. Suitable variations to provide good phosphorus retention in an engine are disclosed, for instance, in US published application 2008-0015129, see, e.g., claims. Non-phosphorus-containing anti-wear agents include borate esters (including borated epoxides), dithiocarbamate compounds, molybdenum-containing compounds, and sulfurized olefins.

Other types of antiwear agents include tartrate esters, tartramides, and tartrimides, such as oleyl tartrimide, as well as esters, amides, and imides of hydroxy-polycarboxylic acids in general. These materials may also impart additional functionality to a lubricant beyond antiwear performance, sometimes or especially in the presence of some ZDP. These materials are described in greater detail in US Publication 2006-0079413 and PCT publication WO2010/077630.

Another component frequently used is a viscosity modifier. Viscosity modifiers (VM) and dispersant viscosity modifiers (DVM) are well known. Examples of VMs and DVMs may include polymethacrylates, polyacrylates, polyolefins, hydrogenated vinyl aromatic-diene copolymers (e.g., styrene-butadiene, styrene-isoprene), styrene-maleic ester copolymers, and similar polymeric substances including homopolymers, copolymers, and graft copolymers. The DVM may comprise a nitrogen-containing methacrylate polymer, for example, a nitrogen-containing methacrylate polymer derived from methyl methacrylate and dimethylaminopropyl amine.

Examples of commercially available VMs, DVMs and their chemical types may include the following: polyisobutylenes (such as Indopol™ from BP Amoco or Parapol™ from ExxonMobil); olefin copolymers (such as Lubrizol™ 7060, 7065, and 7067 from Lubrizol and Lucant™ HC-2000L and HC-600 from Mitsui); hydrogenated styrene-diene copolymers (such as Shellvis™ 40 and 50, from Shell and LTD 7308, and 7318 from Lubrizol); styrene/maleate copolymers, which are dispersant copolymers (such as LTD 3702 and 3715 from Lubrizol); polymethacrylates, some of which have dispersant properties (such as those in the Viscoplex™ series from RohMax, the Hitec™ series of viscosity index improvers from Afton, and LZ® 7702, LZ® 7727, LZ® 7725 and LZ® 7720C from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Viscosity modifiers that may be used are described in U.S. Pat. Nos. 5,157,088, 5,256,752 and 5,395,539. The VMs and/or DVMs may be used in the functional fluid at a concentration of up to 20% by weight. Concentrations of 1 to 12%, or 3 to 10% by weight may be used.

Pour point depressants may include alkylphenols and derivatives thereof, or ethylene vinyl acetate copolymers, and mixtures thereof.

Other additives that may optionally be used in lubricating oils include extreme pressure agents, color stabilizers and anti-foam agents.

The lubricants described herein may be used for the lubrication of mechanical devices, especially those mechanical devices, such as internal combustion engines, for which the presence and retention of basicity (TBN) is desirable. Such engines include those fueled by gasoline, diesel fuel, alcohol, gasoline-alcohol mixtures, and biodiesel fuels. In many such engines, the lubricant is often supplied from a sump. For other engines, the lubricant may be supplied from a storage vessel.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is found in paragraphs [0137] to [0141] of published application US 2010-0197536.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

The effect of various dispersants on the rate of neutralization (removal of TBN) of overbased detergents is examined. TBN neutralization/retention is determined by a stopped-flow neutralization test. This test uses a technique called stopped-flow kinetics, which rapidly mixes an acid-containing solution (or mixture) with a secondary solution, in this case, containing the mixture of detergent and dispersant to be tested. The detergent/dispersant solution is made by diluting the corresponding concentrated additives in a hydrocarbon solvent. The dilution range, or concentration, is chosen to give a suitable total reaction time, typically between 0.1 and 5 seconds. The acid-containing solution is a dispersion of aqueous sulfuric acid droplets in the same hydrocarbon solvent. The concentration of sulfuric acid within the aqueous phase is 0.05 M. In order to monitor the reaction progress by a UV-visible spectrometer, a water-soluble pH-sensitive dye is also added to the dispersed aqueous phase. The spectrometer monitors the color and color change of the dye over a few seconds (typically about 10 seconds) as the basic detergent neutralizes the sulfuric acid. A rate constant is thereby determined from the rate of color change, and rate constants are determined over a range of TBN values. The overall rate of acid neutralization (that is, the rate constant per unit of TBN) is determined from the gradient of the relationship between TBN and rate constant, with units of $s^{-1}TBN^{-1}$. For each of these series of tests, the amount of dispersant is about 2× the amount of detergent. (The neutralization rate numbers are not corrected for the amount of diluent oil present, but the TAN and TBN values for the dispersants are corrected.)

| Ex. | Detergent | Dispersant | Neutralization rate, $sec^{-1}TBN^{-1}$ |
|---|---|---|---|
| 1* | overbased Ca alkyl phenate, 418 TBN | none | 3.2 |
| 2 | same as 1 | A: polyisobutene succinic anhydride condensate with polyethylene amine and penta-erythritol, 0.64% N, 8.7 TAN, 7.3 TBN | 1.1 |
| 3 | same as 1 | B: polyisobutene succinic anhydride condensate with aromatic amine, 7.2 TAN, 0.4 TBN | 0.18 |
| 4 | same as 1 | C: polyisobutene succinic acid 45 TAN, 0 TBN | a |
| 5* | Ca alkyl phenate, 199 TBN | none | 32 |
| 6 | same as 5 | A | 4.37 |
| 7 | same as 5 | B | 1.13 |
| 8 | same as 5 | C | 0.70 |
| 9* | overbased Ca alkyl sulfonate, 690 TBN | none | 1.2 |
| 10 | same as 9 | A | 0.62 |
| 11 | same as 9 | B | a |
| 12 | same as 9 | C | a |
| 13* | Mixture of detergents of Ex 1 and Ex 9, wt ratio 15:1 | none | 8.82 |
| 14 | same as 13 | C | 5.68 |
| 15 | same as 13 | C | 1.2 |
| 16 | same as 13 | C | 0.28 |

*A comparative or reference example a. Neutralization too slow to measure (e.g., <0.1 $s^{-1}TBN^{-1}$)

An engine test is run to further assess TBN retention. The engine test is the VW T4 test, using procedure PV1449 provided by Volkswagen. Two tests are run: Ref Ex. 17: a baseline containing conventional additives (viscosity modifier, pour point depressants, antioxidants, conventional succinimide dispersant (5.1%, having TAN of 8.3 and TBN of 18), the detergent of Ex. 1 (0.85%), the detergent of Ex. 9 (0.23%), zinc dialkyldithiophosphates, amide friction modifier, and corrosion inhibitor) and Ex. 18: the same formulation but further containing 0.29% of the dispersant designated as "C" above. The TBN of the lubricant as a whole (not corrected for oil) is measured at the beginning of the test and at then end of test (248 hours). The results are reported in the table below:

| | Ex 17 (ref) | Ex. 18 |
|---|---|---|
| TBN, start of test | 7.46 | 7.36 |
| TBN, end of test | 6.14 | 6.40 |
| % TBN depletion | 17.7 | 12.9 |

The results show that the use of a high TAN dispersant can slow the depletion of TBN and provide improved TBN retention in an actual engine test.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricant composition comprising:

(a) an oil of lubricating viscosity;

(b) at least one metal-containing detergent in an amount to provide at least about 2 to about 10 TBN to the lubricant, said detergent being present in an amount of about 0.5 to about 2 weight percent; said metal-containing detergent comprising an overbased calcium phenate or an overbased calcium sulfonate or mixtures thereof;

(c) a dispersant comprising an oleophilic portion comprising at least about 40 carbon atoms and an acid-bearing portion, wherein said dispersant is present in an amount of at least about 0.1 percent by weight and up to 1.5 percent by weight, and wherein said dispersant provides at least about 0.10 TAN to the lubricant composition; wherein said dispersant is a polyolefin-substituted succinic acid; wherein the lubricant composition has a sulfated ash value of about 0.05 percent up to about 1.1 percent;

wherein the weight ratio of the metal containing detergent to the polyolefin-substituted succinic acid dispersant is about 4:1 to about 1:1.

2. The lubricant composition of claim 1 wherein the metal-containing detergent comprises a calcium phenate detergent.

3. The lubricant composition of claim 1 wherein the metal-containing detergent or detergents is present in an amount to provide at least 4 TBN to the lubricant.

4. The lubricant composition of claim 1 wherein the lubricant has a sulfated ash value of about 0.3 to about 0.8 percent.

5. The lubricant composition of claim 1, further comprising an additional dispersant having a TAN:TBN ratio of less than 0.8.

6. The lubricant composition of claim 1 further comprising at least one of an antioxidant, a friction modifier, an anti-wear agent, a viscosity modifier, or a pour point depressant.

7. The lubricant composition prepared by admixing the components of claim 1.

8. A method for lubricating a mechanical device, comprising supplying thereto the lubricating composition of claim 1.

9. The method of claim 8 wherein the mechanical device comprises an internal combustion engine.

10. A method for improving the retention of TBN in a lubricant employed for lubricating an internal combustion engine, wherein the lubricant comprises (a) an oil of lubricating viscosity and (b) at least one metal-containing detergent in an amount to provide at least about 2 to about 10 TBN to the lubricant, said detergent being present in an amount of about 0.5 to about 2 weight percent; said metal-containing detergent comprising an overbased calcium phenate or an overbased calcium sulfonate or mixtures thereof; said method comprising including within said lubricant (c) a dispersant comprising an oleophilic portion comprising at least about 40 carbon atoms and an acid-bearing portion, wherein said dispersant is present in an amount of at least about 0.1 percent by weight and up to 1.5 percent by weight and wherein said dispersant provides at least about 0.10 TAN to the lubricant composition; wherein said dispersant is a polyolefin-substituted succinic acid; wherein the lubricant composition has a sulfated ash value of about 0.05 percent up to about 1.1 percent;

wherein the weight ratio of the metal containing detergent to the polyolefin-substituted succinic acid dispersant is about 4:1 to about 1:1.

11. The lubricant composition of claim 1 having a sulfated ash level of up to about 1.0 percent.

12. The lubricant composition of claim 1 wherein the amount of the metal-containing detergent is about 0.5 to about 1.5 weight percent.

* * * * *